United States Patent [19]

Moore

[11] Patent Number: 4,573,864

[45] Date of Patent: Mar. 4, 1986

[54] REGENERATIVE TURBOMACHINE

[76] Inventor: Alan Moore, 4 Partickhill Ave., Glasgow G11 5AA, Scotland

[21] Appl. No.: 640,852

[22] Filed: Aug. 15, 1984

[30] Foreign Application Priority Data

Aug. 19, 1983 [GB] United Kingdom ..... 8322367

[51] Int. Cl.[4] ..... F04D 5/00

[52] U.S. Cl. ..... 415/53 T; 415/56

[58] Field of Search ..... 415/11, 52, 53 R, 53 T, 415/55, 56, 179, 213 T

[56] References Cited

U.S. PATENT DOCUMENTS

| | | | |
|---|---|---|---|
| 986,942 | 3/1911 | Parsons | 415/56 |
| 3,070,349 | 12/1962 | Stewart et al. | 415/56 X |
| 3,869,220 | 3/1975 | Tayler | 415/56 |
| 3,982,848 | 9/1976 | Schonwald et al. | 415/53 T |
| 4,441,855 | 4/1984 | Tayler | 415/53 T |

*Primary Examiner*—Edward K. Look
*Assistant Examiner*—Joseph M. Pitko
*Attorney, Agent, or Firm*—Stevens, Davis, Miller & Mosher

[57] ABSTRACT

A regenerative turbomachine, especially a compressor, in which the working fluid entering via an inlet (16) is divided into slip and counter flow stream. In the each direction, guide means define successive passes through the rotor blades (13) in a generally axial sense. In the slip direction, successive passes ($1_{DS}$, $2_{DS}$, $3_{DS}$, etc) are made so as to reintroduce the fluid to the rotor blades at circumferential positions spaces successively in the direction of intended rotor rotation. In the counter flow path successive passes ($1_{DC}$, $2_{DC}$, $3_{DC}$, etc) are made so as to reintroduce the fluid at circumferential positions spaced successively in the direction counter to the intended direction of rotor rotation. The slip and counter flow paths are brought together at a common outlet (21), thus obviating the need for a conventional stripper. Intercooling (24) may be provided in at least some passes.

8 Claims, 7 Drawing Figures

SLIP FLOW

COUNTER FLOW

REGENERATIVE TURBOMACHINE

Figure 1:
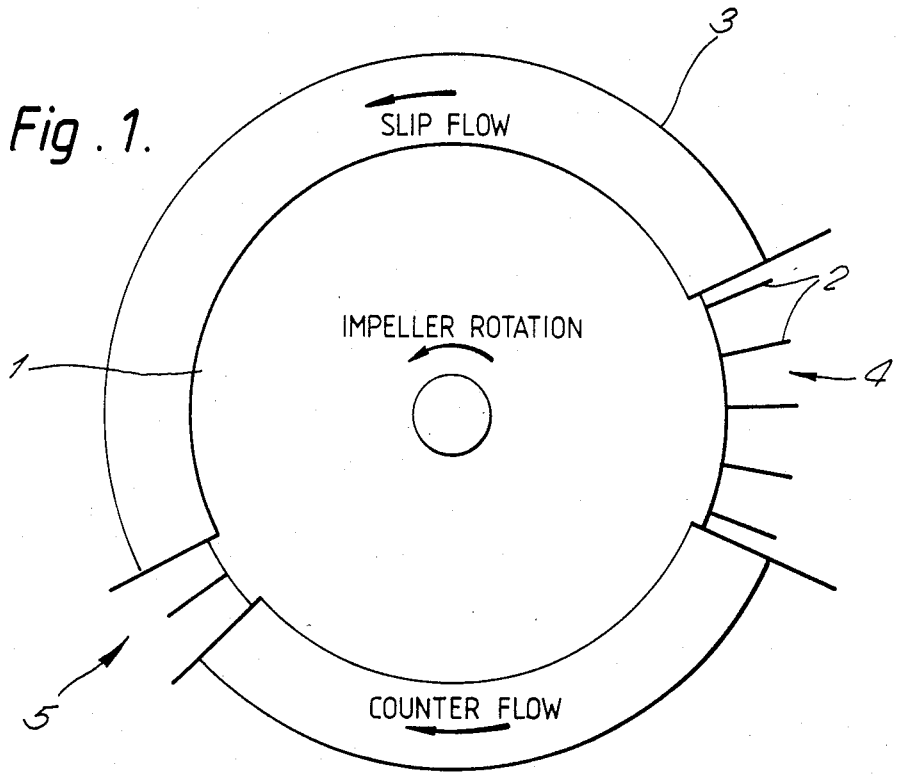

The invention concerns an improved form of regenerative turbomachine.

In regenerative pumps or compressors of known form, fluid to be pressurized or compressed passes through an inlet port either axially or obliquely into an annular housing or shroud which surrounds a bladed rotor. Within the shroud there is also contained an annular core which is supported in such a way as to be spaced from the rotor blades and from the walls of the shroud. The blading is so designed that air (or other working fluid) is drawn into and passes around the annular shroud with a spiral motion around the core in the general directon of rotor rotation. In circulating around the core, the fluid makes repeated passes through the blading in a generally axial sense, and at each pass the pressure of the fluid is thereby increased. A fluid outlet port is provided just before the inlet port, by which the pressurised fluid can leave the shroud. Between the inlet and outlet ports there is provided a stripper which blocks passage of gas around the shroud, and conforms closely to the blade tips so as to minimise leakage of pressurized fluid, which has completed a circuit of the shroud, to the inlet port.

The conventional regenerative compressor is capable of generating a pressure ratio of the order of 2:1 but only at a low isothermal efficiency of the order of 25–35%, depending upon flowrate and design of machine. An isothermal efficiency approaching 60% is attainable, but only at a low pressure ratio, perhaps of the order of 1.2:1.

The conventional regenerative compressor is thus not a very efficient machine, and a great deal of the inefficiency is attributable to losses in the region of the stripper, in particular to (i) leakage past the stripper which sustains the full pressure difference between inlet and outlet ports, and (ii) carry-over in the blade pockets of fluid at outlet pressure back to the inlet.

Very high solidity designs have been produced with the object of reducing carrying-over, but this has led to high viscous losses, and hence little or no net gain in efficiency. Similar considerations apply to conventional regenerative pumps.

The present invention aims to provide a regenerative turbomachine in which the need for a stripper is avoided, and hence the losses associated therewith can also be avoided.

Accordingly the present invention provides a regenerative turbomachine comprising a bladed rotor;

an annular housing surrounding the rotor and defining an annular flow channel for a working fluid;

an inlet port for admitting the fluid to the housing;

an outlet port spaced circumferentially of the rotor from the inlet port, by which the fluid can leave the housing;

and guide means for guiding the fluid entering the inlet port through a slip flow path and a counter-flow path, each flow path making successive passes through the blading in a generally axial sense, wherein in the slip flow path successive passes are made which reintroduce the fluid to the rotor blades at circumferential positions spaced successively in the direction of intended rotor rotation, and in the counter flow path successive passes are made which reintroduce the fluid to the rotor blades at circumferential positions spaced successively in the direction counter to the intended direction of rotor rotation.

It should be understood that in the counter flow path there need not be a net flow of working fluid in the counter direction. In the counter flow path, the guide means are such as to lead the fluid from an exit point on the downstream side of the rotor around to a re-entry point the upstream side, the re-entry on the upstream side being at a point spaced circumferentially in the counter direction from the exit point. The relative flow path, and hence the pressure transfer is thus in the counter direction. However, working fluid will also be carried in the slip direction, in the spaces between the blades, and this flow in the slip direction may exceed the flow through the guide means in the counter direction. Nevertheless, it is still possible to create a positive circumferential pressure gradient from inlet to outlet in the counter direction.

Normally the slip and counter flow paths are brought together in the region of the outlet port, although conceivably each path might have a separate outlet port.

The invention has greatest advantage when the turbomachine is a compressor.

Preferably there are then provided heat exchangers in the said flow paths for removing heat of compression after at least some of said successive passes.

The annular housing preferably conforms closely to the blade tips so as to minimise leakage therepast.

The gap between the rotor blades and the guide means both on the upstream and on the downstream side of the rotor may be varied in order to facilitate the change of direction of the fluid flow under the influence of the circumferential pressure gradient. This will normally mean that for optimum performance the axial gap between the rotor blades and the guide means will be smaller at the high pressure (outlet) ends of the annular flow paths (slip and counter flow) than that at the low pressure (inlet) ends. This is because the fluid deflection in the axial gap will be greater in the high pressure stages than the low.

The guide means may include a flow splitter vane (or vanes) at the inlet port for assisting in distributing the fluid between slip and counter flow paths.

The flow splitter may serve to direct the slip flow portion of the fluid flow in an angular direction different from that of the counter flow, each angle being optimally chosen at the design condition.

Figure 2:
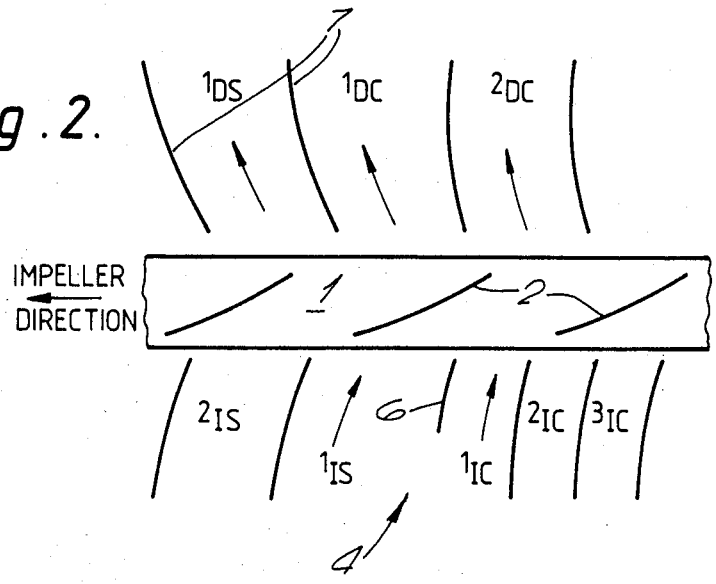
Figure 3:
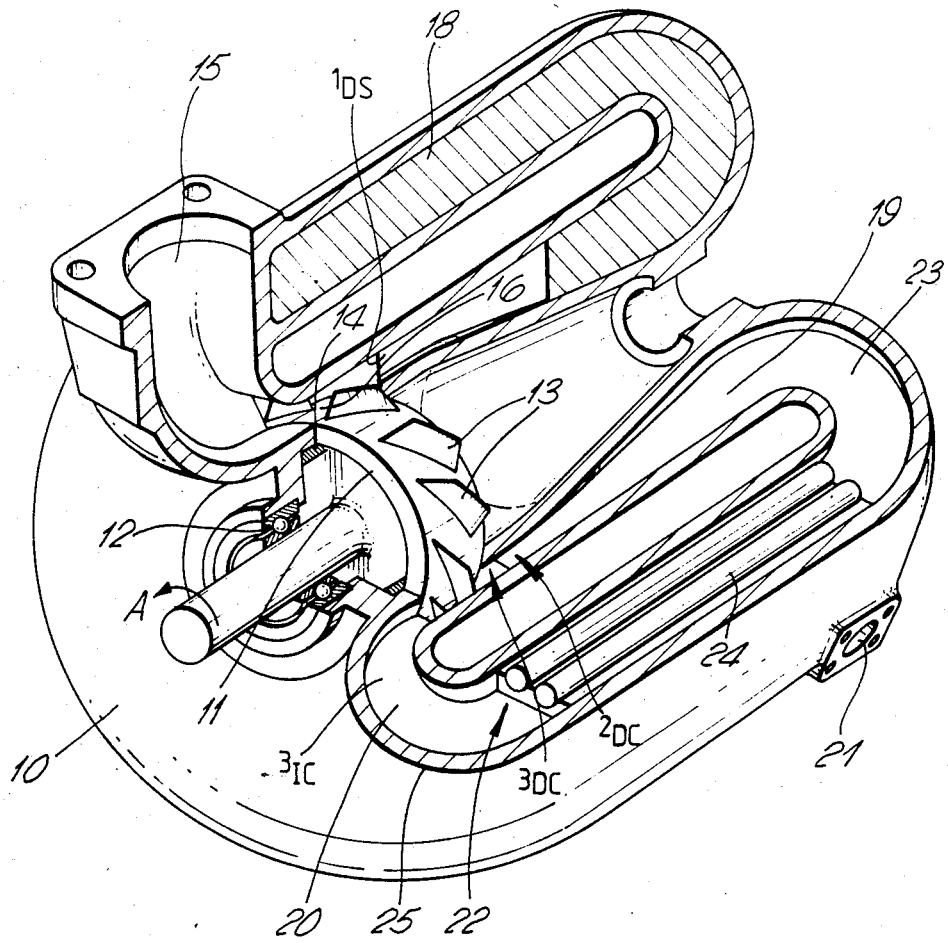
Figure 4:
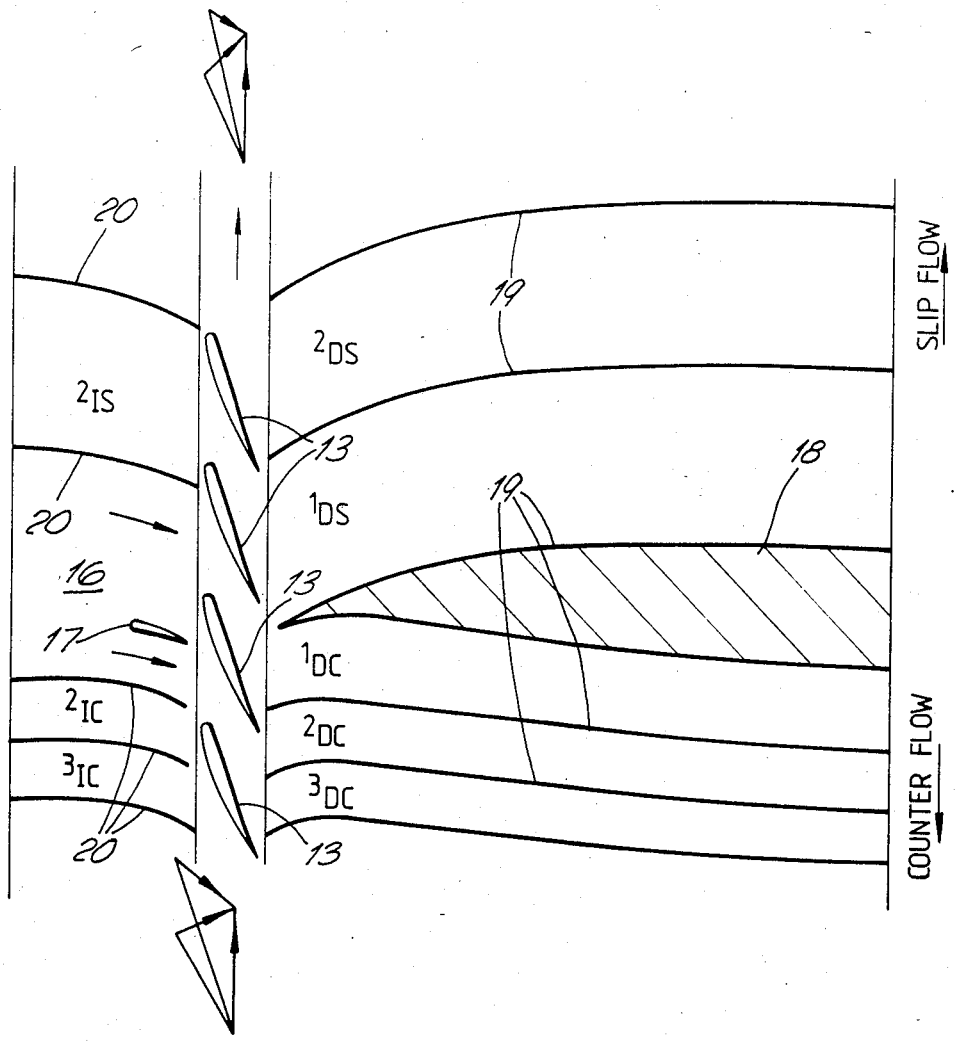
Figure 5:
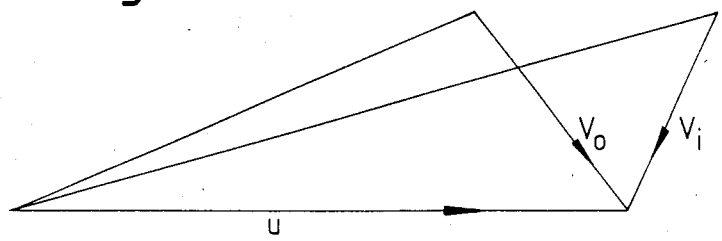
Figure 6:
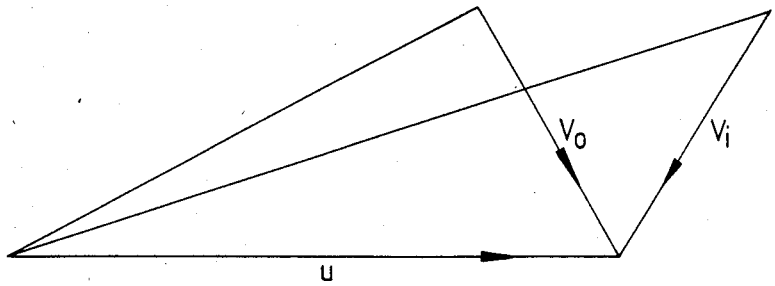
Figure 7:
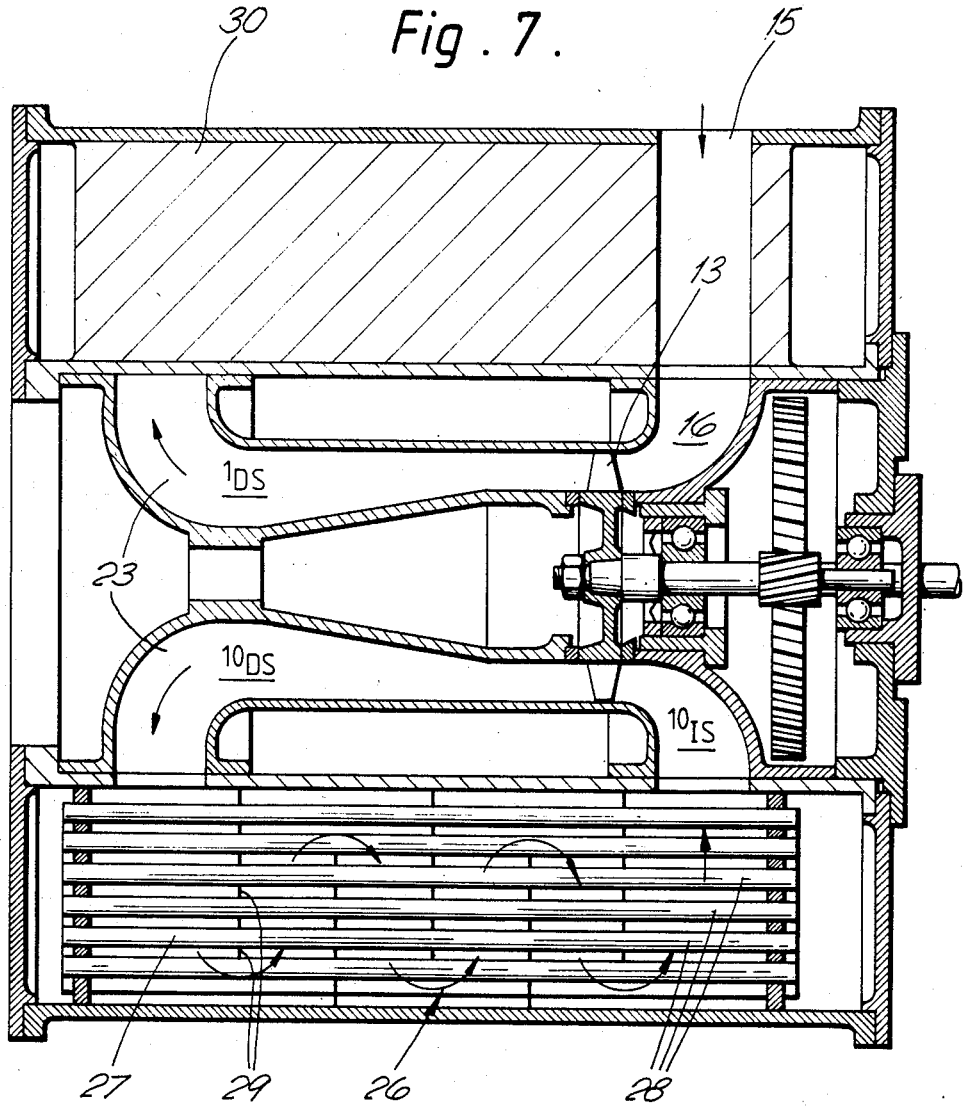

The invention will now be described by way of example only with reference to the accompanying drawings, of which FIG. 1 is a simple schematic view of a turbomachine illustrating the principal of the invention, FIG. 2 is a simple schematic view representing a partial development on the mean surface of the impeller of the machine of FIG. 1, FIG. 3 is a perspective view, partly cut away, of a regenerative compressor according to the invention, FIG. 4 is a schematic view representing a partial development on the mean surface of the impeller of the compressor of FIG. 3, FIGS. 5 and 6 are velocity triangles representing the flow of fluid through the impeller for slip and counter flow paths for the compressor of FIG. 3, and FIG. 7 shows in sectional elevation a modified form of regenerative compressor in accordance with the invention.

As shown schematically in FIGS. 1 and 2, a regenerative turbomachine in accordance with the invention comprises a rotor or impeller 1 provided with blades 2 around its periphery. An annular housing 3 surrounds the rotor and hence defines an annular flow channel for a working gas, and the housing is provided with an inlet port 4 and an outlet port 5 for the fluid. At the inlet port 4 there is provided a splitter vane 6, which serves as a guide to distribute the incoming fluid between a slip flow path $1_{IS}$ and a counter flow path $1_{IC}$. The fluid enters via the inlet port 4 at an angle to the plane of the impeller, and possibly with a component of velocity counter to the blade movement. As the fluid passes through the blading, work is done on each stream. The fluid makes a pass in an axial sense through the blading, and is received and guided by a series of diffusers $1_{DS}$, $1_{DC}$, $2_{DC}$ etc, defined by a series of guide vanes 7. Fluid is collected by the diffuser $1_{DS}$, and is guided to re-enter the blading through a path $2_{IS}$ at a location displaced from the inlet 4 circumferentially in the slip direction. After a plurality of such passes the fluid is directed to discharge via the outlet port 5.

The fluid in the counter flow path is collected by the diffuser $1_{DC}$ after passing through the blading 2 in a generally axial sense. This fluid is guided to make a second pass through the blading via a path $2_{IC}$ which enters the blading at a location displaced from the inlet 4 in the counter-flow direction. Fluid is collected by the diffuser $2_{DC}$, and re-enters the blading at $3_{IC}$ etc. After a plurality of such passes, leaving and entering the blading at points displaced successively in the counter flow direction, the fluid is directed to discharge via the outlet port 5.

The fluid pressure at the outlets of slip and counter flow paths thus must be the same, and the fluid flows through the two paths are thus self-balancing. It is not necessarily the case that the fluid in the two paths will make the same number of circuits. The need for a stripper to block outlet and inlet is obviated along with its attendant disadvantages. It will be appreciated that not all fluid entering by a particlar inlet guide will necessarily leave by any particular outlet diffuser at each pass—there will be some leakage and carry-over.

Indeed, in the counter direction, the mass flow rate of gas carried over between the blades may exceed the flow in the counter direction through the guide means. The absolute flow, even on the "counter" side, may thus be in the slip direction. Nevertheless, the relative flow (ie relative to the moving rotor) must be in the counter direction, because the physical configuration of the guide means necessarily results in this. It is the relative flow which determines the distribution of pressure, and thus a positive pressure gradient in the counter direction is still achieved even when the absolute flow is in the slip direction.

In FIG. 3 there is shown a perspective view, partially cut away, of a regenerative compressor embodying the principles described with reference to FIGS. 1 and 2. As seen in FIG. 3, a regenerative compressor comprises a casing 10 in which there is supported a rotor 11 by means of a bearing 12. The rotor is intended to rotate in an anti-clockwise direction as indicated by the arrow A. The rotor carries a plurality of blades 13 around its periphery, and the casing 10 defines an annular housing which surrounds and conforms closely to the blade tips. The axial gap between the rotor blades and the guide means on both the upstream and the downstream sides is smaller at the high pressure (outlet) ends of the annular flow paths (slip and counter flow) then that at the low pressure end. This is to compensate for the greater deflection induced in the high pressure stages. For example, calculations show that for one design of machine, fluid traversing an axial gap of 1 mm at the inlet will develop a circumferential component of velocity under the influence of the circumferential pressure gradient of only 1.4 m/s. At the high pressure end of the machine (outlet), under the same operating conditions, the traverse of a 1 mm axial gap gives rise to a circumferential velocity rise of 9.5 m/s. Gas seals (one shown at 14) are provided to prevent the escape of gas from the housing radially inwards between rotor 11 and casing 10. The gas seals 14 should be so designed that they inhibit leakage in the circumferential direction from the high to low pressure ports of the machine.

Gas can be admitted to the housing via an inlet manifold 15 which turns the flow through 90° and leads to an inlet port 16 which communicates with the annular housing containing the rotor blades 13. A guide vane 17 (FIG. 4) divides the inlet flow in the manifold 15 into a slip flow stream and a counter flow stream. FIG. 4 is a diagrammatic view of the annular section developed on a mean blade radius in the locality of the inlet port, showing the flow paths for slip and counter flow streams in this area; velocity triangles for slip and counter flow are shown in FIGS. 5 and 6 respectively, where u represents the mean blade velocity, $V_i$ the inlet gas velocity and $v_o$ the outlet gas velocity vectors. As shown, the velocity triangles call for preswirl counter to the direction of rotation of the rotor. This need not necessarily be so, but the inlet guide vanes can advantageously provide preswirl in both slip and counter flow directions.

The guide vane 17 in this instance serves to direct the inlet flow in the counter flow direction. The divided flow therefore passes through the blading 13 where work is performed thereon to increase its pressure, and in this example leaves the blading at a location substantially axially opposite the inlet. Fluid is collected in the slip and counter flow $1_{DS}$ and $1_{DC}$, in which the flow is straightened and the maximum of kinetic energy is recovered therefrom into the form of pressure energy. The two diffuser passages $1_{DS}$ and $1_{DC}$ are separated from each other by a flow splitter 18. The slip and counter flows are guided by diffuser vanes 19 and inlet guide vanes 20 so as to make repeated passes through the rotor blading in a substantially axial direction, as described with reference to FIGS. 1 and 2. The pressure of the gas is increased at each pass as a result of the work performed thereon by the rotor blades.

The slip flow thus for example enters at the inlet port 16, its pressure is increased by passage through the blade 13, and it leaves the annular housing in the slip direction. The fluid in diffuser $1_{DS}$ is guided by means of the vanes 19, 20 to re-enter the blading via the second slip inlet $2_{IS}$ which is displaced circumferentially in the slip direction from the inlet 16 although some leakage and carry-over will occur in practice. Thence, the slip flow passes through the blading 13 where its pressure is further increased, and so on through a plurality of such passes until the outlet port (not shown) is reached. Flow in the counter flow direction similarly occurs. Fluid from the first counter flow direction diffuser $1_{DC}$ is guided around to the second counter flow inlet guide $2_{IC}$ by the vanes 19, 20; hence through the blades. Fluid from the second counter flow diffuser $2_{DC}$ is guided round to the third counter flow inlet guide $3_{IC}$. Successive pass through the rotor blades taking place further in the counter flow direction, until the same outlet is reached. Here again, there may be no absolute flow in the counter direction.

The slip and counter flow streams are thus mingled and discharged from the outlet manifold 21.

The sectioned portion of the drawing at 22 shows the guided flow path for one typical complete pass, in this case from entry to the diffuser $2_{DC}$ the counter flow stream is first straightened in the diffuser section, is smoothly turned through 180° in the curved section 23, and is then returned via a heat exchanger 24 which serves to remove the heat of compression. A particularly useful feature of compressors in accordance with the invention is that the removal of heat of compression in small individual increments is made possible, leading to a valuable increase in isothermal efficiency. The heat exchanger 24 also serves to isolate the flow physically from flow in the adjacent counter flow pass. The flow is then turned through a further 180° in the smooth U-bend 25, to re-enter the blading 13 via the next succeeding counter flow inlet $3_{IC}$. Flow leaving the blades is then collected by the diffuser $3_{DC}$ in the next succeeding pass. Intercooling will normally be provided on some but not all passes.

In FIG. 7 there is shown a regenerative compressor similar in most significant respects to that just described with reference to FIGS. 3 to 6. In FIG. 7, like reference numerals have been used to denote like parts. The principal difference is that the simple heat exchangers 24 are replaced by a more complex heat exchanger 26. The heat exchanger 26 comprises an annular chamber 27 containing an array of cooling tubes 28, and an arrangement of baffles 29 which forces the gas to take a tortuous path through the exchanger tubes. The chamber 27 is divided by radial splitters 30, which separate the flows in each individual stage or pass. The radial splitters are required to sustain only a relatively low pressure difference even in the final stages. The tenth slip diffuser $10_{DS}$ and inlet guide $10_{IS}$ are shown in the section.

It will be appreciated that the operation of the machines according to the invention in the manner described will depend upon operating conditions, and in general optimum design operation will occur only when the rotor runs at the design speed, and inlet and outlet pressures are at the design values. However, acceptable performance may be obtained under conditions approaching the design conditions, and it may be possible to offset one change in the design parameters against another.

I claim:

1. A regenerative turbomachine comprising a bladed rotor;

an annular housing surrounding the rotor and defining an annular flow channel for a working fluid;

an inlet port for admitting the fluid to the housing;

an outlet port spaced circumferentially of the rotor from the inlet port, by which the fluid can leave the housing;

and guide means for guiding the fluid entering the inlet port through a slip flow path and a counter-flow path, each flow path making successive passes through the blading in a generally axial sense, wherein in the slip flow path successive passes are made which reintroduce the fluid to the rotor blades at circumferential positions spaced successively in the direction of intended rotor rotation, and in the counter flow path successive passes are made which reintroduce the fluid to the rotor blades at circumferential positions spaced successively in the direction counter to the intended direction of rotor rotation.

2. A regenerative turbomachine according to claim 1 being a compressor.

3. A regenerative compressor according to claim 2 wherein there are provided heat exchangers in the said flow paths for removing heat of compression after at least some of said successive passes.

4. A regenerative turbomachine according to claim 1 wherein the annular housing conforms closely to the blade tips so as to minimise leakage therepast.

5. A regenerative turbomachine according to claim 1 wherein the axial gap between the rotor blades and the guide means decreases around the rotor circumference from inlet to outlet.

6. A regenerative turbomachine according to claim 1 wherein the rotor is provided with one or more hub seals for controlling fluid leakage in the radial and circumferential directions.

7. A regenerative turbomachine according to claim 6 wherein the flow splitter serves to direct the slip flow portion of the fluid flow at an angular direction different from that of the counter flow portion.

8. A regenerative turbomachine according to claim 1 wherein the guide means includes one or more flow splitter vanes at the inlet port for assisting in distributing the fluid between the slip and counter flow paths.

* * * * *